US006016582A

United States Patent [19]

Larson

[11] Patent Number: 6,016,582

[45] Date of Patent: Jan. 25, 2000

[54] AIR SUPPORT PILLOW TOP ASSEMBLY

[76] Inventor: Lynn D. Larson, 5410 NW. 44th St., Lincoln, Nebr. 68524

[21] Appl. No.: 09/118,503

[22] Filed: Jul. 17, 1998

[51] Int. Cl.[7] ..... A47C 17/00

[52] U.S. Cl. ..... 5/691; 5/709; 5/710; 5/716; 5/727

[58] Field of Search ..... 5/691, 708, 709, 5/710, 713, 716, 727, 655.3

[56] References Cited

U.S. PATENT DOCUMENTS

| | | | |
|---|---|---|---|
| 3,017,642 | 1/1962 | Rosenberg et al. | 5/709 |
| 4,424,600 | 1/1984 | Callaway | 5/502 |
| 4,454,615 | 6/1984 | Whitney | 5/691 |
| 5,060,328 | 10/1991 | Larson | 5/450 |
| 5,097,552 | 3/1992 | Viesturs | 5/691 |
| 5,159,725 | 11/1992 | Larson | 5/451 |
| 5,253,377 | 10/1993 | Larson | 5/451 |
| 5,303,435 | 4/1994 | Haar et al. | 5/709 |
| 5,335,380 | 8/1994 | Larson | 5/255 |
| 5,740,573 | 4/1998 | Boyd | 5/711 |

*Primary Examiner*—Alexander Grosz
*Attorney, Agent, or Firm*—Zarley,McKee,Thomte Voorhees & Sease; Dennis L. Thomte

[57] ABSTRACT

An inflatable pillow top includes a fabric case with an inflatable bladder contained therein. The inflatable bladder is coextensive with the fabric case, and the mattress upon which it is secured. The bladder may be inflated by a conventional air pump with a pressure control, or it may be self-inflating. The self-inflating bladder includes a compressible foam material filling the bladder and having memory to return to an expanded condition. An inlet valve on the bladder permits air to enter the bladder as the foam material expands, thereby filling the bladder with air. An exhaust valve is provided to permit adjustment of the air pressure within the bladder.

6 Claims, 4 Drawing Sheets

AIR SUPPORT PILLOW TOP ASSEMBLY

TECHNICAL FIELD

The present invention relates generally to bed mattresses, and more particularly to a pillow top assembly for a mattress which may be inflated with air to provide variable support.

BACKGROUND OF THE INVENTION

A conventional bed assembly includes a bed frame, support springs, and a mattress. Most mattresses are formed in such a manner that they can be reversed and/or inverted, in order to counteract mattress sagging from continued weight of users in a single position.

Pillow tops have been used in the prior art to extend the useful life of a mattress. The prior art pillow top has usually been relatively thin, and consists of a cushioned pad coextensive with the length and width of the mattress and located on the top surface of the mattress. The pillow top thereby provides additional cushioning on a mattress, while simultaneously protecting the mattress from soiling.

Prior art pillow tops are commonly attached to either the upper or lower surface of the mattress, using hook and loop fasteners, zippers, buttons and the like. These fasteners typically were provided on both sides of the mattress so that the pillow top could be attached or reattached after inverting the mattress.

Another function of the prior art pillow top assembly was to provide additional cushioning and support to a user. In this way, a consumer could purchase either a thin, or thick pillow top, depending upon the amount of support and cushioning desired. However, prior art pillow top assemblies were not capable of providing adjustable support.

SUMMARY OF THE INVENTION

It is therefore a general object of the present invention to provide an improved pillow top assembly with adjustable support.

A further object is to provide a pillow top which may be attached and detached from a mattress.

Yet another object of the present invention is to provide a pillow top which may be adjustably inflated with air to adjust the support provided by the pillow top.

Still another object is to provide a pillow top which is simple to use, economical to manufacture and refined in appearance.

These and other objects of the present invention will be apparent to those skilled in the art.

The inflatable pillow top of the present invention includes a fabric case with an inflatable bladder contained therein. The inflatable bladder is coextensive with the fabric case, and the mattress upon which it is secured. The bladder may be inflated by a conventional air pump with a pressure control, or it may be self-inflating. The self-inflating bladder preferably includes a compressible foam material within the bladder which has memory to return to an expanded condition. An inlet valve on the bladder permits air to enter the bladder as the foam material expands, thereby filling the bladder with air. An exhaust valve is provided to permit adjustment of the air pressure within the bladder.

DESCRIPTION OF THE PREFERRED EMBODIMENT

Figure 1:
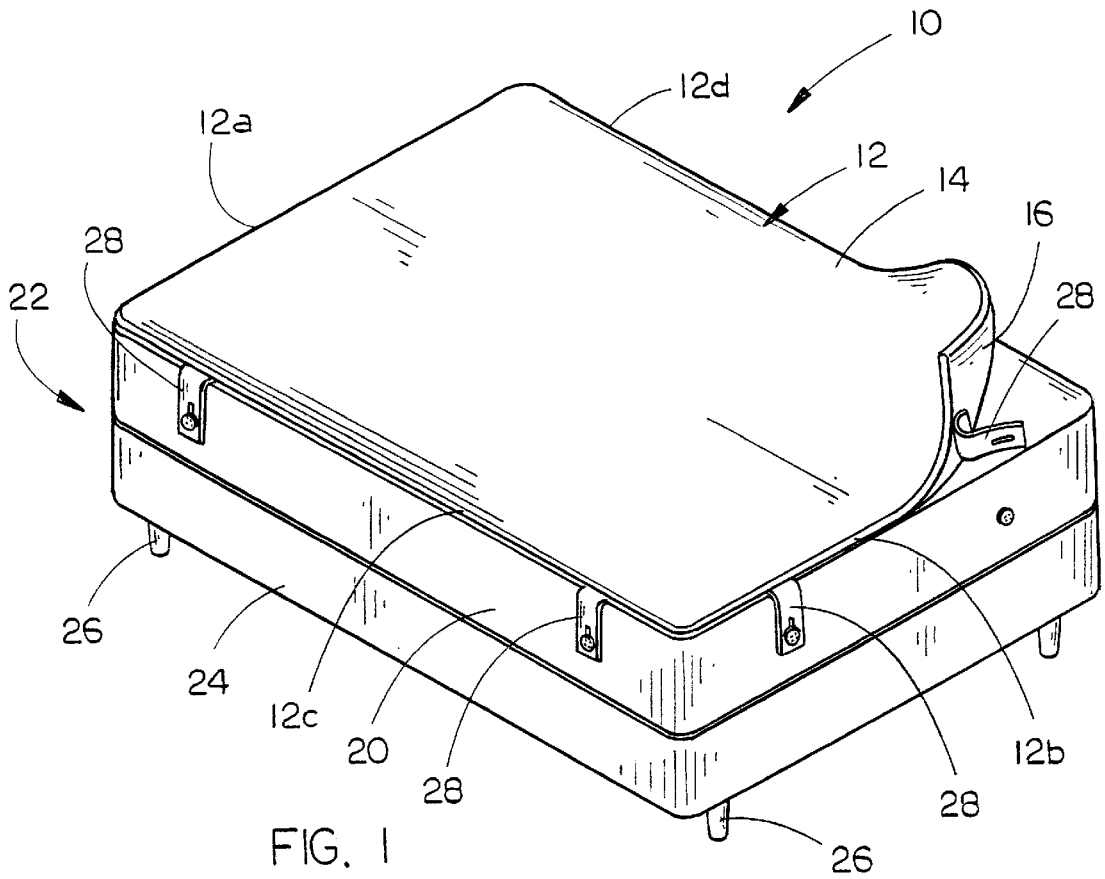
FIG. 1 is a perspective view of the pillow top of the present invention attached to a mattress.

Referring now to the drawings, in which similar or corresponding parts are identified with the same reference numeral, and more particularly to FIG. 1, the pillow top of the present invention is designated generally at 10 and includes a fabric case 12 having an upper sheet 14 connected to a lower sheet 16 along head and foot ends 12*a* and 12*b*, respectively, and opposing sides 12*c* and 12*d*. Case 12 includes an inflatable air bladder 18 (shown in FIG. 3) to provide a soft and comfortable cushion and support for a mattress 20.

Pillow top 10 is attached to a bed assembly 22, which includes a box spring 24 supported on a bed frame with feet 26, and mattress 20 atop box spring 24. As shown in FIG. 1, mattress 20 has a length and width substantially the same as box spring 24, and pillow top 10 has a length and width substantially the same as mattress 20.

A plurality of straps 28 are attached to the sides 12*c* and 12*d* and head and foot 12*a* and 12*b* of case 12, and project outwardly therefrom. Each strap is selectively connected to the mattress 20, to permit attachment and removal of pillow top 10 from mattress 20.

Figure 2:
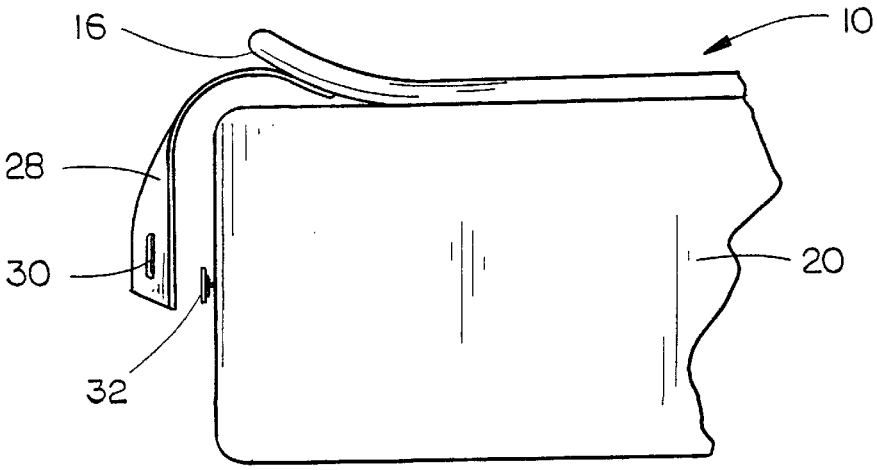
FIG. 2 is an end elevational view of a portion of a mattress with the pillow top disconnected from the mattress.

As shown in FIG. 2, one version of the invention includes straps 28 attached to the bottom sheet 16 of pillow top 10, with a buttonhole 30 formed in the free end thereof for selective attachment to a button 32 on the side of the mattress 20.

Figure 3:
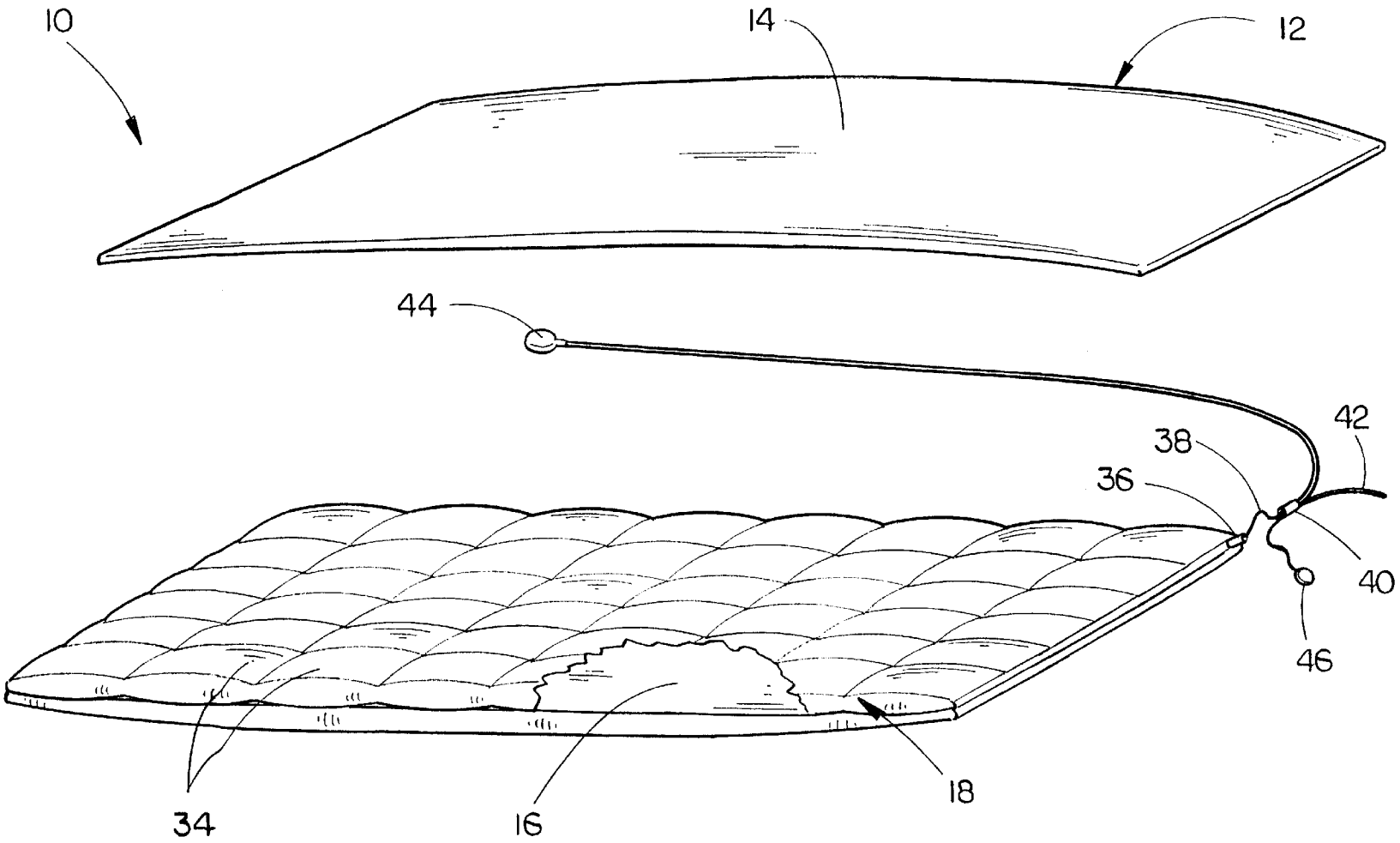
FIG. 3 is an exploded perspective view of the pillow top, showing the interior air bladder.

Referring now to FIG. 3, pillow top 10 is shown in exploded view, with upper sheet 14 and lower sheet 16 separated to show the air bladder 18 contained within the case 12. Air bladder 18 is provided with a plurality of individual air chambers 34 which are fluidly connected together. An air inlet valve 36 is fluidly connected to the air bladder 18 with a pneumatic line 38 (shown in schematic form) extending to an air pump 40. Air pump 40 has a conductor 42 extending to a power supply, for selectively operating the air pump to inflate bladder 18.

A pneumatic pressure control 44 is electrically connected to pump 40 to selectively inflate bladder 18 to the desired pressure. A pressure sensor 46 is connected to the pneumatic line 38 to detect the pressure of the air bladder 18.

Obviously, the greater pressure within the bladder 18, the firmer the pillow top. Further, if desired, the individual air chambers 34 may be sealed from one another with each of the air chambers 34 being fluidly connected to the air pump 40, pressure control 44 and pressure sensor 46 to permit the air pressure within each air chamber 34 to be selectively controlled to provide greater or less air pressure in certain areas of the pillow top. Additionally, a group of air chambers 34 may be fluidly connected together with that group being fluidly connected to the air pump 40, pressure control 44 and pressure sensor 46 to permit the air pressure within that group of air chambers 34 to be selectively controlled to provide greater or less air pressure in a certain area of the pillow top.

In operation, pillow top 10 is selectively attached to a mattress 20, as shown in FIG. 1. The mattress 20 may be of any selected firmness, but is preferably quite firm. This is because pillow top 10 will provide a softening cushion, if a less firm cushion is desired. The consumer will adjust the pressure of air bladder 18 with control 44 and air pump 40 to provide the desired cushion and support over the particular individual.

Figure 4:
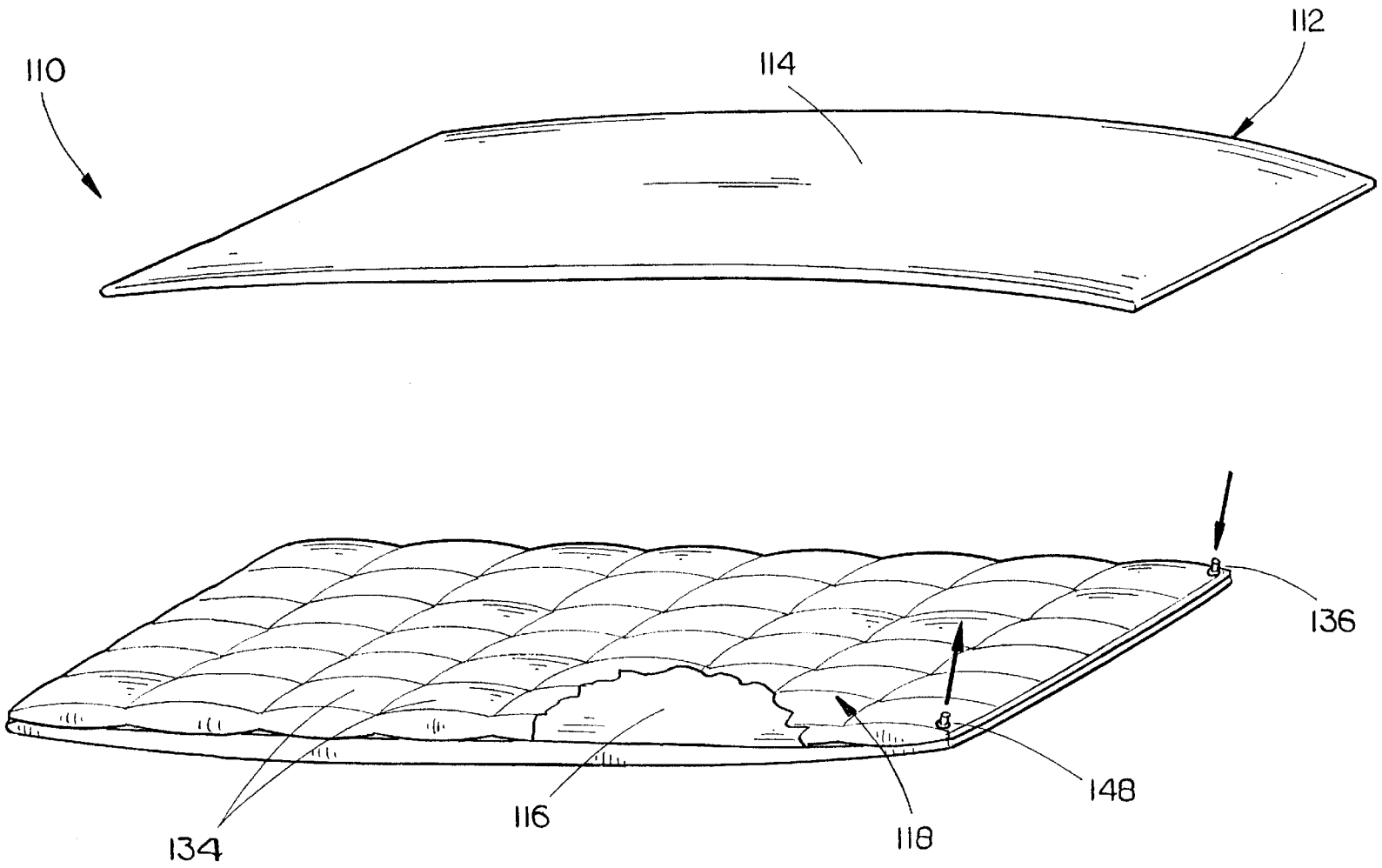
FIG. 4 is a view similar to FIG. 3, showing a second embodiment of the invention.

Referring now to FIG. 4, a self-inflating pillow top 110 is disclosed. Pillow top 110 includes the same case 112 and upper and lower sheets 114 and 116, as the first embodiment of the invention. In addition, the same air bladder 118 is provided extending coextensive with the upper and lower sheets 114 and 116.

Pillow top 110 differs from the first embodiment of the invention, in the use of foam filled air chambers 134. The foam within each of the air chambers 134 is preferably of a sponge-like material, which is compressible but has memory to return to its expanded state.

Although it is preferred that foam be used in the air chambers 134, the air chambers could have compressible plastic springs, compressible metal springs, cotton, wool, polyester, or other expansion means therein. A one-way inlet valve 136 is provided in air bladder 118, and a second adjustable relief valve 148.

In operation, pillow top 110 is shipped in a deflated condition, with the air bladder 118 rolled up, or otherwise compressed, to remove air and compress the foam within the air chambers 134. Inlet valve 136 remains closed during shipment, to prevent air from entering bladder 118. Once the pillow top 110 has been positioned as desired, relief valve 148 is closed, and inlet valve 136 is opened. The compressed foam within air chambers 134 will return to its expanded condition, thereby drawing air in through inlet valve 136, and inflating bladder 118. When the foam filled chambers 134 have expanded to the extent possible, inlet valve 136 is closed. The consumer may then adjust the desired cushioning and support by adjusting relief valve 148 to exhaust the desired amount of air pressure.

Figure 5:
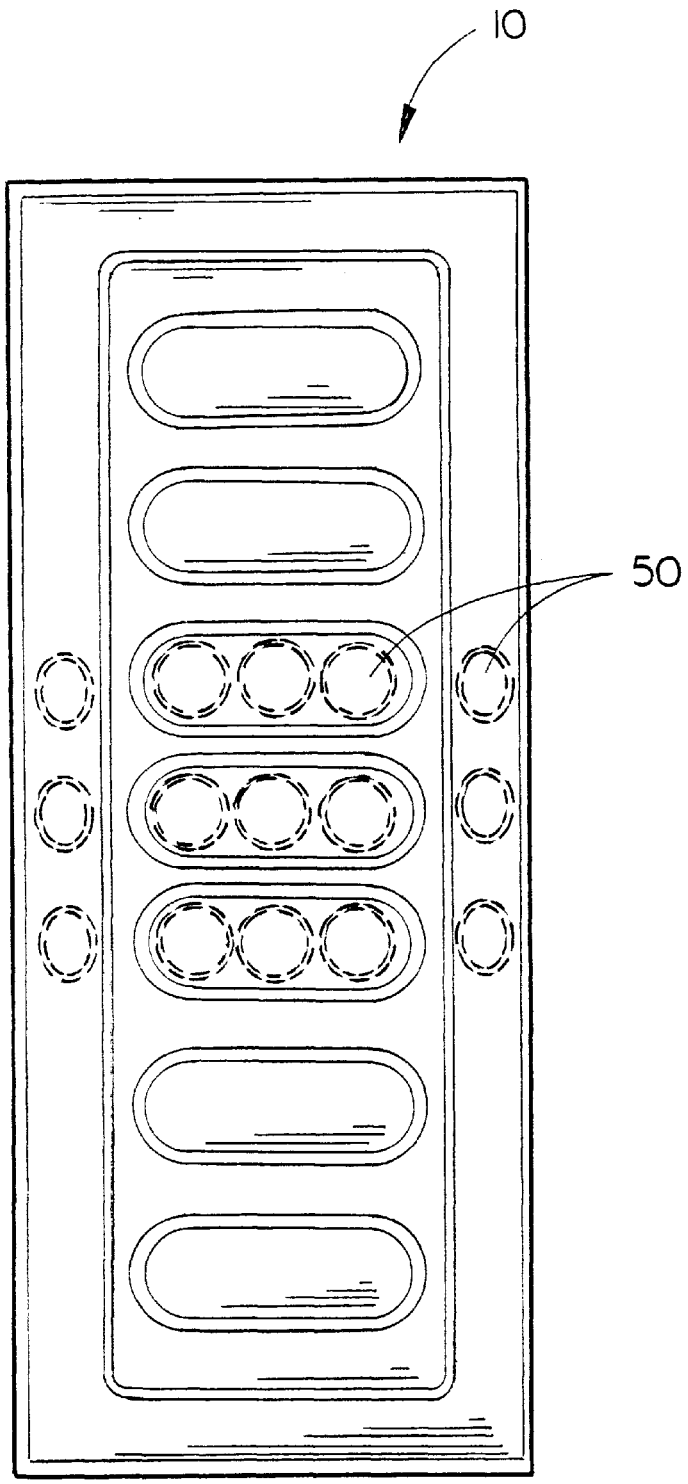
FIG. 5 is a plan view of a pillow top showing interior support coils.

As shown in FIG. 5, the pillow top 10 may be provided with a plurality of cushioning coils 50 for providing additional support in desired locations. As shown in FIG. 5, coils 50 span the transverse extent of the pillow top 10, but covers only a large central portion of the pillow top, longitudinally. Since most concentrated loads on the pillow top 10 are due to a consumer sitting on the pillow top, this action generally occurs within the longitudinal extent of the pillow top shown by the placement of coils 50 in FIG. 5. Coils 50 may be of any conventional type, such as spring bellows, or coil springs. Because the top surface of an air filled pillow top 10 is more susceptible to deflection by a concentrated load, coils 50 assist in uniformly distributing the concentrated loads.

Whereas the invention has been shown and described in connection with the preferred embodiment thereof, many modifications, substitutions and additions may be made which are within the intended broad scope of the appended claims.

I claim:

1. An inflatable pillow top, adapted to be releasably attached to a mattress to cover the top surface of the mattress, comprising:

a case including an upper sheet connected along opposing sides and head and foot ends to a lower sheet, to form an enclosure therebetween;

an inflatable bladder, comprised of fluidly interconnected air chambers contained within the case, and substantially coextensive with the upper and lower sheets; means for selectively inflating the bladder including compressible foam material filling each air chamber, having memory to return to an expanded condition to expand the air chambers and draw air therein; an inlet valve in the air bladder, operable to permit air flow into the air bladder and prevent air flow out of the bladder; an outlet valve in the air bladder, selectively operable to permit air flow out of the bladder and prevent air flow into the bladder; and a plurality of springs arranged within the bladder extending vertically, to provide additional support at the spring locations.

2. The pillow top of claim 1, wherein said case is comprised of fabric.

3. The pillow top of claim 1, wherein said springs are bellows type springs.

4. The pillow top of claim 1, wherein said springs are arranged across the transverse extent of the bladder, and generally centrally longitudinally less than the full longitudinal extent of the bladder.

5. The pillow top of claim 1, wherein said pillow top further includes:

a plurality of connector straps attached at a first end along the head end, foot end, and sides of the case, and extending outwardly therefrom; and each connector strap having a free second end, with means thereon for detachable connecting the second end to a side wall of a mattress.

6. The pillow top of claim 1, wherein said bladder includes a plurality of individual air chambers with the said air chambers being fluidly connected together in groups, and means for selectively inflating said groups of air chambers.

* * * * *